United States Patent [19]

Igarashi

[11] Patent Number: 4,926,729

[45] Date of Patent: May 22, 1990

[54] ENVELOPE OPENER

[75] Inventor: Hideo Igarashi, Tokyo, Japan

[73] Assignee: Elm Industry Co., Ltd., Tokyo, Japan

[21] Appl. No.: 390,854

[22] Filed: Aug. 8, 1989

[30] Foreign Application Priority Data

Sep. 5, 1988 [JP] Japan ..... 63-115895

[51] Int. Cl.[5] ..... B26D 5/38; B26D 1/14

[52] U.S. Cl. ..... 83/364; 53/381 R; 83/372; 83/492; 83/912; 414/412

[58] Field of Search ..... 83/912, 370, 360, 364, 83/372, 494, 467 R; 53/381 R; 414/412

[56] References Cited

U.S. PATENT DOCUMENTS

| | | | |
|---|---|---|---|
| 2,607,421 | 8/1952 | Anderson | 83/372 X |
| 2,656,889 | 10/1953 | Kaplan | 83/372 |
| 2,672,930 | 3/1954 | Iffland | 83/372 |
| 3,381,564 | 5/1968 | Whiteford | 83/417 |
| 4,419,915 | 12/1983 | Oussani | 83/433 |

*Primary Examiner*—Frank T. Yost

*Assistant Examiner*—Kenneth E. Peterson

*Attorney, Agent, or Firm*—Armstrong, Nikaido, Marmelstein, Kubovcik & Murray

[57] ABSTRACT

An envelope opener having a pair of entries in its opposite sides through which an envelope may enter the opener from either side to have its head automatically cut as it passes through the opener, comprises: cutters driven by a reversible electric motor; a lane for guiding the envelope, interrupted by the cutters; a pair of bar-type sensors swingably mounted crossing the lane, each being positioned in opposite sides of the cutters; a link connecting the sensors with each other to swing the sensors in synchronism when one is swung by an envelope passing through the lane; and contact assemblies coupled with the sensors, one of the assemblies being operated by the of the sensors to establish rotational directions of the motor and the cutters when the envelope entered the opener from either side swings one of the sensors to bring the other through the link into a position where the other of the contact assemblies coupled with the other of the sensors remains opened.

1 Claim, 4 Drawing Sheets

ENVELOPE OPENER

BACKGROUND OF THE INVENTION

1. Field of the Invention

The present invention relates to an envelope opener, and more particularly to a double entry type envelope opener provided with a pair of entries in opposite ends of an envelope guide lane for guiding the head or closure flap portion of an envelope to be cut, through which entries the head of the envelope may enter the guide lane of the opener to have its head or closure flap portion automatically cut as the latter passes through the guide lane of the opener.

2. Description of the Prior Art

A conventional envelope opener is a single-entry type opener provided with an entry in an end of the envelope guide lane, through which entry the head or closure flap portion of the envelope may enter the guide lane of the opener to have its head or closure flap portion automatically cut as it passes through the guide lane. Such conventional opener has a construction in which rotary disc blades are rotated by an electric motor in a predetermined single direction to permit the head or closure flap portion of the envelope to enter the guide lane of the opener through such entry of the guide lane, whereby the head of the envelope is automatically cut as the latter passes through the guide lane of the opener in a predetermined single direction.

In the conventional single-entry type envelope opener, as described above, since the rotary disc blades are rotated in the predetermined single direction to automatically cut the head or closure flap portion of the envelope as the latter passes through the guide lane of the opener in the predetermined single direction, it is not possible for the envelope to enter the opener theough the other side of the opener so as to pass through the opener in a direction counter to the above predetermined single direction, and, therefore, in this respect, the conventional envelope opener is poor in easiness for use.

SUMMARY OF THE INVENTION

It is an object of the present invention to provide a double-entry type envelope opener provided with a pair of entries in its opposite sides through which entries the head or closure flap portion of an envelope may enter an envelope guide lane of the opener from either side to have its head automatically cut as the latter passes through the guide lane of the opener in either direction

.

The envelope opener of the present invention is provided with such a reversible electric motor and a pair of rotary disc blades driven thereby that are able to automatically change their rotational direction according to envelope's entry direction to the opener without employing a specialized misoperation prevention system, and accordingly the opener of the present invention permits the envelope to enter the guide lane of the opener from either side entry thereof so as to pass therethroug in either direction, whereby the head of the envelope may be automatically cut as the latter passes through the guide lane of the opener. Thus, there can be provided such improved double-entry type opener that is very easy for use.

The above object of the present invention is accomplished by providing:

A double-entry type envelope opener provided with a pair of entries in its opposite sides through which an envelope may enter the opener from either side to have its head automatically cut as the latter passes through the opener, comprising:

a reversible electric motor;

a pair of rotary disc blades driven by the reversible electric motor, the rotary disc blades being vertically arranged;

a guide lane horizontally extending for guiding the envelope therethough, the guide lane being centrally interrupted by the pair of rotary disc blades;

a pair of bar-type swingable sensors vertically mounted on the guide lane so as to cross the latter, the bar-type swingable sensors being positioned in opposite sides of the pair of rotary disc blades;

a link connecting the pair of bar-type swingably sensors with each other to deive one of the bar-type swingable sensors on synchronism with the other when the one is swinged by an envelope passing through the guide lane; and a pair of contact assemblies coupled with the pair of bar-type swingable sensors, one of the contact assemblies being operated by the one of the bar-type swingable seneors to establish rotational directions of the reversible electric motor and the rotary disc blades when the head of an envelope enters the opener from either entry and passes the guide land in either direction to swing the one of the bar-type swingable sensors, which in turn moves the other through the link into a position where the other of the contact assemblies coupled with the other of the bar-type swingable sensors remains opened or turned off.

DESCRIPTION OF THE PREFERRED EMBODIMENT

Figure 1:
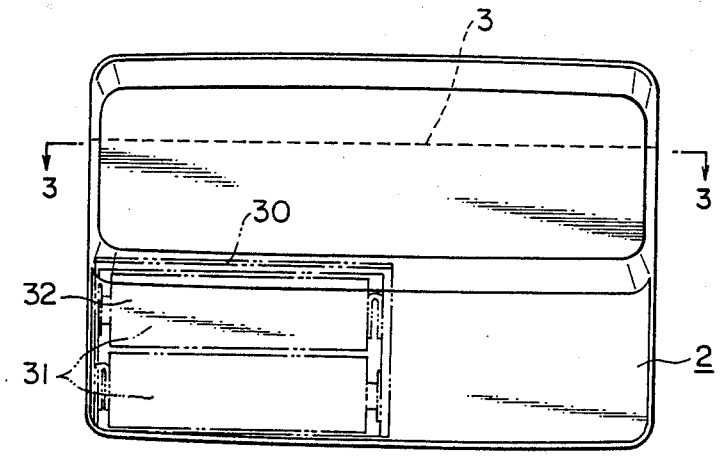
FIG. 1 is a plan view of the envelope opener of the present invention.
Figure 2:
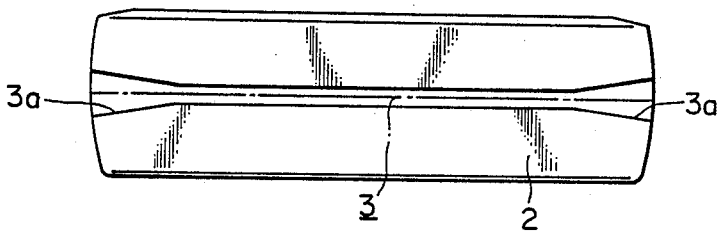
FIG. 2 is a front view of the envelope opener of the present invention.

The present invention will now be described in detail, by way of example, with reference to the accompanying drawings in which like reference numerals apply to similar parts throughout the several views.

Figure 4:
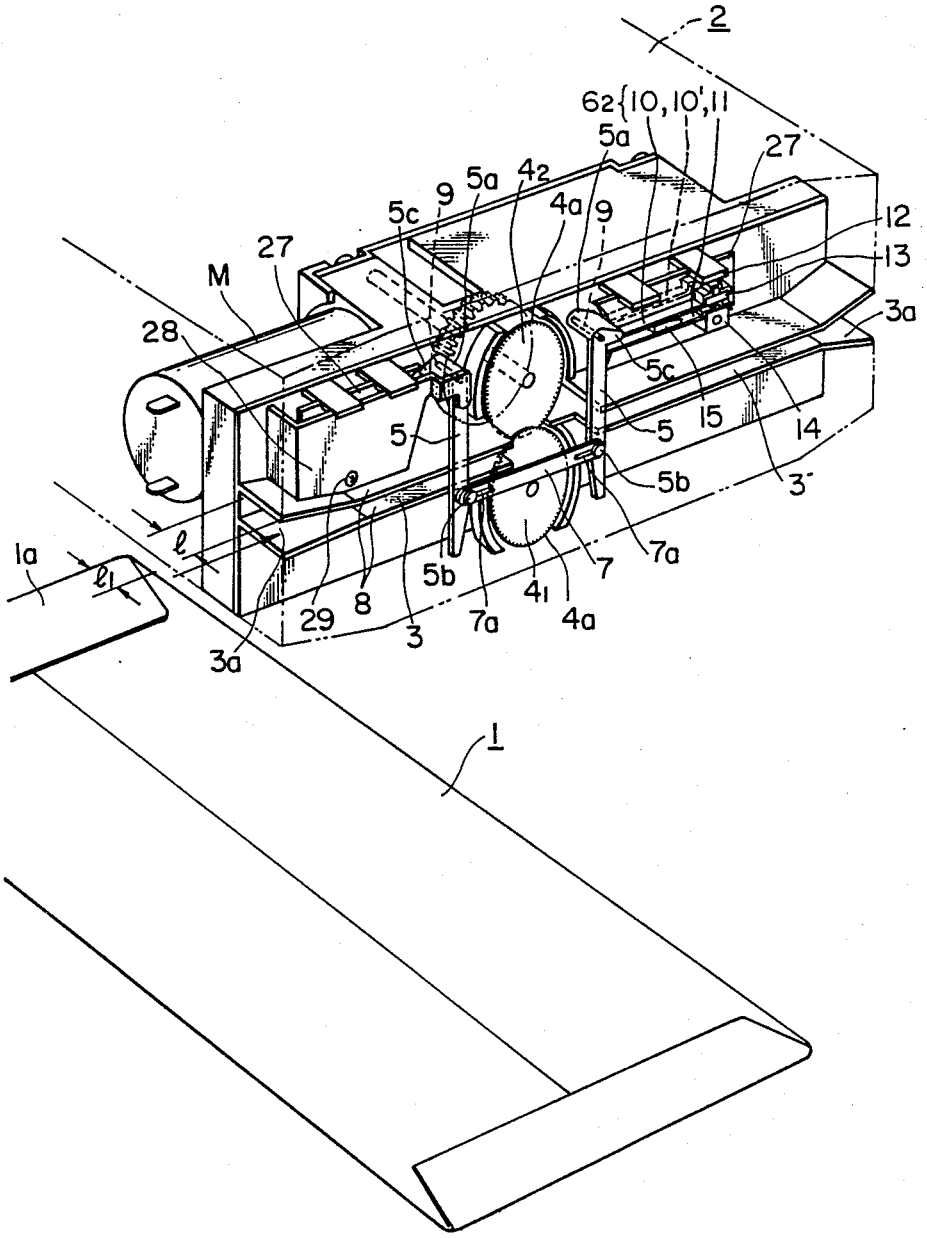
FIG. 4 is a perspective view of an essential part of the envenlope opener of th present invention.

In FIG. 4, the reference numeral 1 denotes an envelope provided with a head or closure flap portion 1*a*.

A double-entry type envelope opener of the present invention is provided with a pair of entries 3*a* in its opposite sides through which an envelope 1 may from either side enter a horizontally extending envelope guide lane 3 to have its head or closure flap portion 1*a* automatically cut as it passes therethrough. As is clear from FIG. 4, the opposite entries 3*a* of the opener are outwardly spreaded inlet openings of the horizontally extending guide lane 3 which may horizontally guide the envelope 1 passing therethrough in either direction. The guide lane 3 is fixedly mounted in a front portion of a split housing 2 of the opener.

The envelope opener of the present invention further comprises: a reversible electrec motor M; a pair of rotary disc blades $4_1$, $4_2$ which may be rotatably driven in either direction by the reversible electric motor M, the rotary disc blades $4_1$, $4_2$ being vertically arranged; a pair of bar-type swingable sensors 5 vertically, symmetrically mounted on the guide lane 3 so as to cross the latter, the bar-type swingable sensors 5 being positined in opposite sides of the pair of rotary disc blades $4_1$, $4_2$ so as to detect or to be swinged by the envelope 1 passing through the guide lane 3 in either direction, whereby controlling rotational direction of the motor M depending on from which entry the envolope enters to the opener; a link 7 connecting the pair of bar-type swingable sensors 5 with each other to drive one of them in synchronism with the other when the one is swingably moved by the envelope 1 passing through the guide lane 3; and a pair of contact assemblies $6_1$, $6_2$ of double-throw switch type coupled with the pair of bar-type swingable sensors 5, one of the contact assemblies $6_1$, $6_2$ being operated by the one of the bar-type swingable sensors 5 so as to establish a rotational direction of each of the reversible electric motor M and the rotary disc blades $4_1$, $4_2$ when the head or closure flap portion 1*a* of the envelope 1 enters the guide lane 3 from either entry 3*a* and passes therethough in either direction to swingably move the one of the bar-type swingable sensors 5, which in turn moves the other through the link 7 into a position in which the other of the contact assemblies $6_1$, $6_2$ coupled with the other of the bar-type swingable sensors 5 remains opened or turned off.

As shown in FIGS. 1 to 4, the split housing 2 is made of plastics, and formed into a flat shape with a portable size to enable the user to carry it in his hand. The split housing 2 may consist of two pieces.

On the other hand, the guide lane 3 is formed in a horizontally elongated form in the interior of the front portion of the housing 2. Namely, as shown in FIG. 4, the guide lane 3 is defined by a pair of horizontally elongated walls 8 which are vertically oppositely disposed from each other. As described above, the opposite end portions, or entries of the guide lane 3 are formed into the outwardly spreaded openings 3*a* for facilitating the envelope 1 to enter from either side of the opener.

Figure 3:
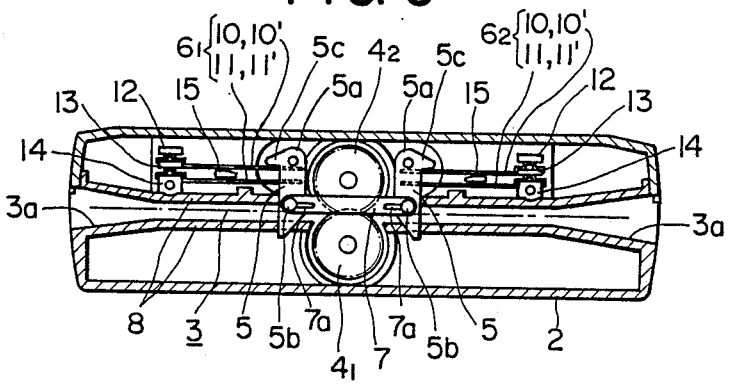
FIG. 3 is a cross-sectional view of the envelope opener of the present invention, taken along the line A—A of FIG. 1.
Figure 6:
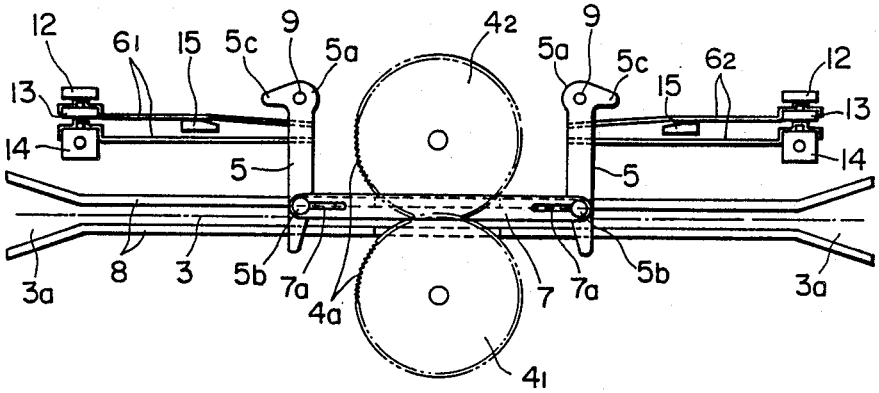
FIG. 6 is a partially enlarged front view of the envelope opener of the present invention during non-use thereof, illustrating relationship between the components of the envelope opener of the present invention such as contact assemblies, bar-type swingable sensors, rotary disc blades and the like, both of the sensors and the blades being positioned in their neutral positions in this condition.

When the head or closure flap portion 1*a* of the envelope 1 enters the guide land 3 of the opener to swing the bar-type swingable sensors 5, the sensors 5 operate the contact assemblies $6_1$, $6_2$ to establish a rotational direction of the motor M. As shown in FIGS. 3, 4 and 6, each of the bar-type swingable sensors 5 is provided with a substantially sleeve-like bearing portion 5*a* in its upper end. In each bearing portion 5*a* is rotatably inserted a supporting pin 9 which is spaced apart from the guide lane 3 and extends horizontally in a direction perpendicular to the longitudinal direction of the guide lane 3, whereby each bar-type swingable sensor 5 may swing in a plane parallel to the longitudinal direction of the guide lane 3. As shown in FIG. 4, during non-use of the envelope opener, the bar-type swingable sensors 5 are substantially perpendicular to the longitudinal axis of the guide lane 3, and parallelly spaced from each other.

On the other hand, the link 7 connecting the sensors 5 with each other is provided with a pair of elongated slits 7*a* on its opposite end portions. In each slit 7*a* is slidably mounted an axle 5*b* which forms a projection provided in a front surface of a lower half portion of each sensor 5.

As described above, the link 7 forms a connecting means for connecting the bar-type sensors 5 with each other. Consequently, when either sensor 5 is swinged by the head or closure flap portion 1*a* of the envelope 1 entered the guide lane 3 through either entry 3*a* thereof, the thus firstly swung sensor 5 swings in turn the other sensor 5 through the link 7 in synchronism therewith, whereby one of the contact assemblies $6_1$, $6_2$ coupled with the firstly swung sensor 5 is closed or turned on to establish rotational directions of the motor M and the rotary disc blades $4_1$, $4_2$ driven thereby. At this time, the firstly swung sensor 5 also brings, through the link 7, the other contact assembly $6_1$ or $6_2$ coupled with the other sensor 5 into a position where the other contact assembly $6_1$ or $6_2$ remains opened or turned off. After passing of the head 1*a* of the envelope 1 through the guide lane 3 of the opener, the bar-type swingable sensors 5 return in synchronism with each other by gravity to their neutral positions where they are substantislly perpendicular to the longitudinal axis of the guide lane 3.

Figure 7:
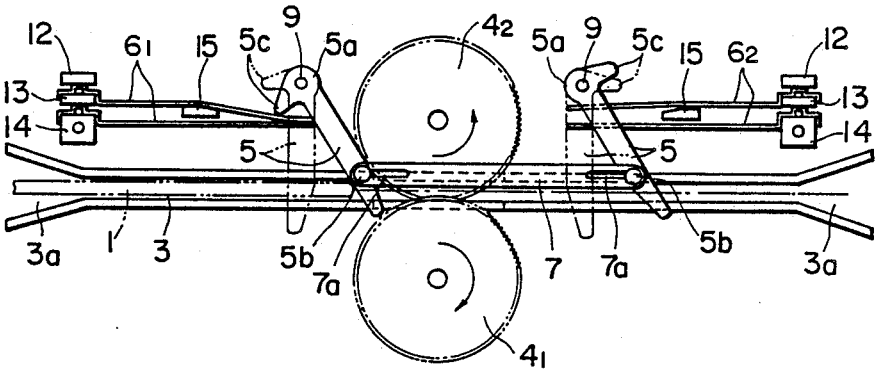
FIG. 7 is a partially enlarged front view of the envelope opener of the present invention in use, illustrating relationship between the components of the envelope opener of the present invention shch as the contact assemblies, bar-type swingable sensors, rotary disc blades and the like, the sensors having been swingably moved to their right positions by the envelope entering the guide lane of the opener from a left entry of the opener.
Figure 8:
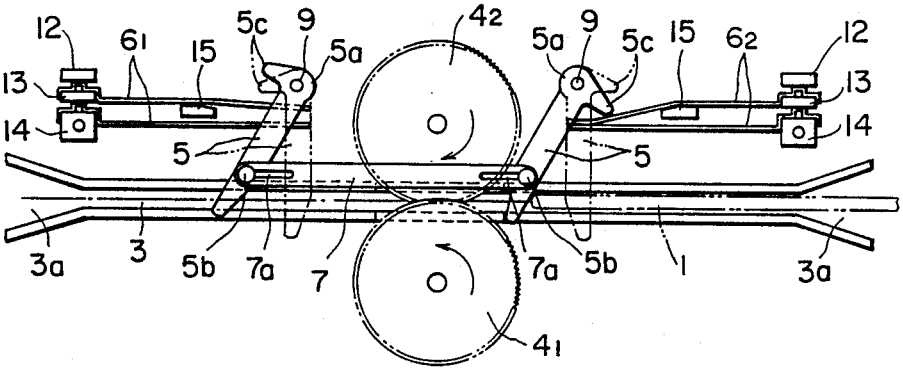
FIG. 8 is a partially enlarged front view of the envelope opener of the present invention in use, illustrating relationship between the components of the envelope opener of the present invention such as the contact assemblies, bar-type swingable sensors, rotary disc blades and the like, the sensors having been swingably moved to their left positions by the envelope entering the guide lane of the opener from a right entry of the opener.

As shown in FIG. 4, the contact assemblies $6_1$, $6_2$ coupled with the bar-type swingable sensors 5 are mounted in an upper front portion of the interior of the split housing 2. As is clear from FIGS. 6 to 8, each of the contact assemblies $6_1$, $6_2$ serves as a double-throw switch for establishing a rotational direction of the reversible electric motor M, and is constructed of moving-contact members 10, 10′ and substantially stationary-contact members 11, 11′, respectively laterally separated by a partition plate 27, as shown in FIG. 4. In each of the contact assemblies $6_1$, $6_2$, the moving-contact members 10, 10′ and the substantially stationary-contact members 11, 11′ are constructed of resilient and electrically-conductive metallic leaf springs, and vertically spaced apart from each other as shown in FIGS. 6 to 8. It is to be understood that reference numerals 10 and 11 denote positive side and 10' and 11' do negative side, respcetively.

As is clear from FIGS. 6 to 8, each end-portion of the moving-contact member 10, 10' are fixedly sandwiched between an upper-holding plate 12 and a middle-holding plate 13, while each end-portion of the substantially stationary-contact members 11, 11' are fixedly sandwiched between the middle-holding plate 13 and a lower-holding plate 14. These holding plates 12, 13, 14 are fixedly mounted in a front portion of the interior of the split housing 2 for facilitating installation of the contact members 10, 10', 11, 11'. The other end-portion of each of the contact members 10, 10', 11, 11' forms a free end to serve as an electrical contact point. A partition plate 15 fixed to the split housing 2 is interposed between the moving-contact members 10, 10' and the substantially stationary-contact members 11, 11' to prevent the contact members 10, 10' 11, 11' from being accidentally brought into contact with each other.

In FIGS. 4 and 6 to 8, the bar-type swingable sensors 5 and the contact assemblies $6_1$, $6_2$ coupled therewith will be now further described in detail with respect to construction. The reference numeral 5*c* denotes a push projection provided in an upper end portion of each bar-type swingable sensor 5. In the pair of the sensors 5, as shown in FIG. 6, the push projections 5*c* thereof symmetrically extend outward or in opposite directions to each other. In operation, when the head or closure flap portion 1*a* of the envelope 1 entered the guide lane 3 of the opener swings either sensor 5, the remaining sensor 5 is also swung in synchronism with thus firstly swung sensor 5 through the link 7, however the only firstly swung sensor 5 causes its push projection 5*c* to push the moving-contact member 10 downward, whereby the push projection 5*c* of the firstly swung sensor 5 is brought into an electrical contact with the corresponding substantially stationary-contact members 11, 11' to close or turn on eithr contact assembly $6_1$ of $6_2$ In the case of FIG. 7, the contact assembly $6_1$ is closed or turned on, while the other contact assembly $6_2$ remained opened or turned off so that a rotational directon of the reversible electric motor M is established by the contact assembly $6_1$ in the case of FIG. 7.

As shown in FIG. 4, the motor M is laterally mounted in the split housing 2 to enable the split housing 2 to assume a flat shape.

As is clear from FIG. 4, the pair of rotary disc blades $4_1$, $4_2$ slightly overlapped each other are vertically arranged in the vicinity of a center line or longitudinal axis of the guide lane 3. An outer peripheral edge portion of each of the rotary disc blades $4_1$, $4_2$ is formed into a sawtooth $4_a$.

Figure 5:
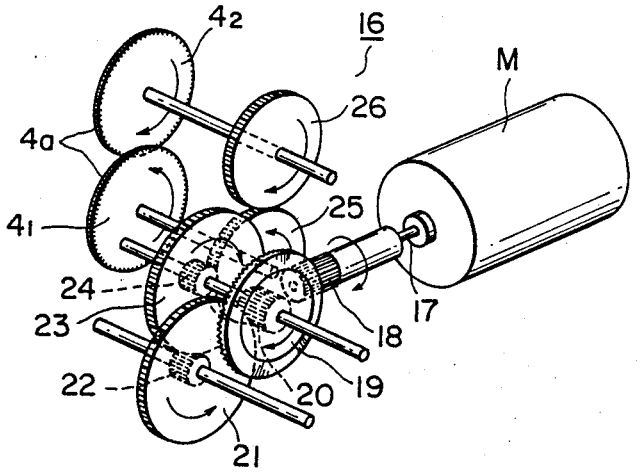
FIG. 5 is a perspective view of an embodiment of a driving mechanism of the envelope opener of the present invention.
Figure 9:
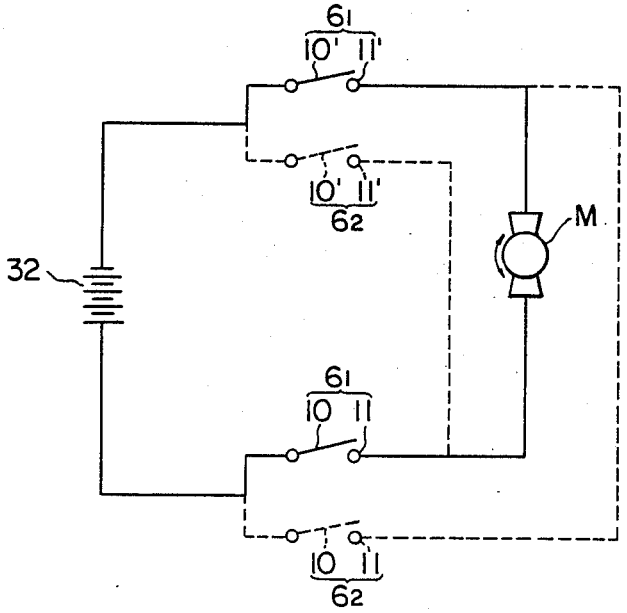
FIG. 9 is an electrical circuit for controlling the rotational direction of the reversible electric motor employed in the envelope opener of the present invention.

As shown in FIG. 5, the power produced in the motor M is transmitted to the rotary disc blades $4_1$, $4_2$ through a transmission mechanism 16.

As is clear from FIG. 5, the transmission mechanism 16 of the envelope opener of the present invention is constructed of: a worm 18 fixedly mounted on a driving shaft 17 of the reversible motor M; a worm gear 19 meshed with the worm 18; a first small gear 20 fixedly and coaxially mounted on an axle of the worm gear 19; a first intermediate gear 21 meshed with the first small gear 20; a second small gear 22 fixedly and coaxially mounted on an axle of the first intermediate gear 21; a second intermediate gear 23 meshed with the second small gear 22; a third small gear 24 fixedly and coaxially mounted on an axle of the second intermediate gear 23; a third intermediate gear 25 meshed with the third small gear 24; and a final gear 26 meshed with the third intermediate gear 25, the final gear 26 being similar in diameter to the third intermediate gear 25.

In FIG. 4, the reference numeral 28 denotes a substantially L-shaped cover plate for covering a front area of each of the contact assemblies $6_1$, $6_2$,the cover plate 28 is detachably mounted on the split housing 2 by means of a screw 29.

In FIG. 1, the reference numeral 30 denotes a battery holder mounted in a rear portion of the split bousing 2. In the battery holder 30 are received a suitable number of dry cells or storage cells 31. The battery holder 30 is closed with a lid 32 detachably mounted on the rear portion of the split housing 2.

Now, operation of the envelope opener of the present invention will be described in detail.

In use, the user holds the opener or split housing 2 in his hand, and, for example as shown in FIG. 7, inserts the head or closure flap portion la of the envelope 1 into the guide lane 3 of the opener through the left entry 3*a* of the guide lane 3.

As a result, when the inserted head or closure flap portion 1*a* of the envelope 1 pushes the left sensor 5 rightward as shown in FIG. 7, both sensors 5 are swinged rightward in synchronism with each other through the link 7 to rotate around their supporting pins 9 counterclockwise as shown in FIG. 7.

Consequently, the push projection 5*c* provided on the upper-end portion of the left sensor 5 pushes the left moving-contact members 10, 10' downward to bring them into electrical contact with the left substantially stationary-contact members 11, 11', whereby the left contact assembly $6_1$ is closed or turned on to establish a rotational direction of the reversible electric motor M. In this case of FIG. 7, the driving shaft 17 of the motor M rotates clockwise so that, as shown in FIG. 5, the power of the motor M is transmitted to the rotary disc blades $4_1$, $4_2$ through the worm 18, worm gear 19, first small gear 20, a first intermediate gear 21, second small gear 22, second intermediate gear 23, third small gear 24, third intermediate gear 25 and the final gear 26 or the transmission mechanism 16. Since the third intermediate gear 25 is similar in diamiter to the final gear 26 meshed therewith, the final gear 26 rotates in a direction counter to that of the third intermediate gear 25. On the other hand, as is clear from FIG. 5, an upper rotary disc blade $4_2$ is fixedly and coaxially mounted on an axle of the final gear 26, while a lower rotary disc blades $4_1$ is fixedly and coaxially mounted on an axle of the third intermediate gear 25. Therefore, the rotary disc blades $4_1$, $4_2$ are rotated in opposite directions to each other by the motor M when the head or closure flap portion 1*a* of the envelope 1 is inserted into the guide lane 3 of the opener by the user, which enhances cutting operation of the rotary disc blades $4_1$, $4_2$ with respect to the envelope 1. Namely, as shown in FIG. 7, the inserted head 1*a* of the envelope 1 is positively and continuously cut by the rotary disc blades $4_1$, $4_2$ as the head or closure flap portion 1*a* of the envelope 1 passes through the guide lane 3 of the opener.

Since the left sensor 5 is connected with the right sensor 5 through the link 7 in operation, the right sensor 5 per se not pushed by the envelope 1 is also swung rightward through the link 7 in synchronism with the left sensor 5 to cause its push projection 5*c* to separate upward from the right woving-contact member 10 so that the right contact assembly $6_2$ remains opened or turned off, whereby the right contact assembly $6_2$ is prevented from being accidentally closed or turned on.

In opeartion of the envelope opener of the present invention, since the head la of the envelope 1 passing through the guide lane 3 of the opener continuously pushes the left sensor 5 until it is completely cut, the opener of the present invention may cut envelopes of various sizes and various thicknesses.

In addition, in the envelope opener of the present invention, since the rotary disc blades $4_1$, $4_2$ rotate in opposite directions to each other as described above and brought into a frictional contact with the head or closure flap portion 1*a* of the envelope 1, these rotary disc blades $4_1$, $4_2$ positively pull the head or closure flap portion 1*a* of the envelope 1 and cut it.

Furthermore, as shown in FIG. 4, which the envelope opener of the present invention, a horizontal distance L between a vertical rear wall of the guide lane 3 and a rear surface of the upper rotary disc blade $4_2$ corresponds to a cutting width $L_1$ of the head or closure flap portion 1*a* of the envelope 1, but it is possible to easily control the cutting width $L_1$ of the head 1*a* of the envelope 1 by controlling the above horizontal distance 1.

When the head 1*a* of the envelope 1 has been completely cut, the bar-type swingable sensors 5 and the link 7 return to their initial positions by gravity to release the left moving contact members 10, 10' from the left substantially stationary-contact members 11, 11'. As a result, the left moving-contact members 10, 10' return to their initial positions by their resiliency to bring the left contact assembly $6_1$ into a turned-off condition, whereby operation of the motor M is stopped, and, therefore operations of the rotary disc blades $4_1$, $4_2$ are also stopped. Consequently, after completion of cutting operation of the head 1*a* of the envelope 1, the bar-type swingably sensors 5 and left contact assembly $6_1$ returns to their initial positions, so that the sensors 5 are positioned to cross the guide lane 3 as shown in FIG. 6.

Now, cutting operation of the head or closure flap portion 1*a* of the envelope 1 in the case of FIG. 8 will be described in detail.

As shown in FIG. 8, when the head or closure flap portion 1*a* of the envelope 1 is inserted into the guide lane 3 of the opener through the right entry 3*a*, the right sensor 5 is swung leftward by the head 1*a* of the inserted envelope 1, so that both sensors 5 swing around the supporting pins 9 clockwise to cause the push projection 5*c* of the right sensor 5 to push the right moving-contact members 10, 10' downward. Accordingly, the right moving-contact members 10, 10' are brought into an electrical contact with the right substantially stationary-contact members 11, 11' to close or turn on the assembly $6_2$, whereby a rotational direction of the reversible electric motor M is established.

As a result, in the case of FIG. 8, the motor M rotates in a direction counter to that of the motor M in the case of FIG. 7, so that the gears 25, 26 connected with the rotary disc blades $4_1$, $4_2$ also rotate in directions counter to those of the gears 25, 26 in the case of FIG. 7. Consequently, the head 1*a* of the envelope 1 is brought into frictional contact with the rotary disc blades $4_1$, $4_2$ and positively cut thereby continuously as it passes through the guide lane 3 leftward.

In the case of FIG. 8, since the head 1*a* of the envelope 1 continuously swings the right seneor 5 until it is completely cut, the right contact assembly $6_2$ is continuously closed or turned on so as to continuously rotate the rotary disc blades $4_1$, $4_2$ in directions shown by arrows in FIG. 8. On the other hand, at this time, since the push projection 5*c* of the left sensor 5 is separated upward from the left moving-contact members 10, 10', there is no fear that the left moving-contact members 10, 10' are accidentally brought into eletrical contact with the left substantially stationary-contact members 11, 11'.

After completion of the cutting operation of the head 1*a* of the envelope 1, since the right sensor 5 is released from the head 1*a* of the envelope 1, it returns to its initial position by gravity, with the push projection 5*c* thereof also returning to its initial position by the resiliency of the right moving-contact members 10, 10' to enhance the gravity return of the right sensor 5. At this time, the left sensor 5 and the link 7 connected to the right sensor 5 also return to their initial positions by gravity, so that the right contact assembly $6_2$ is opened or turned off to stop the motor M in operation. Consequently, the rotary disc blades $4_1$, $4_2$ are also stopped in operation. When the bar-type sensors 5 return to their initial positions, they again cross the guide lane 3 as shown in FIG. 6.

Cutting operation of the head 1*a* of the envelope 1 inserted into the guide lane 3 of the opener through the right entry 3*a* of the guide lane 3 as shown in FIG. 8 is completed as described above.

Incidentally, in the above embodiment of the envelope opener of the present invention, it is also possible to employ such other means in place of the push projections 5*c* provided in the upper-end portions of the bar-type swingable sensors 5, that may be a suitable engaging means constructed of projections and corresponding concave members, a magnetic means, a frictional means or the like.

In addition, in the envelope opener of the present invention, if necessary, the number of the sensors 5 may be one, and the sensors 5 may be arranged horizontally.

What is claimed is:

1. A double-entry type envelope opener provided with a pair of entries in its opposite sides through which an envelope may enter said opener from either side to have its head automatically cut as it passes through said opener, comprising:

a reversible electric motor;

a pair of rotary disc blades driven by said reversible electric motor, said rotary disc blades being vertically arranged;

a guide lane extending horizontally for guiding said envelope, said guide lane being interrupted by said pair of rotary disc blades so that said pair of rotary disc blades cross said guide lane;

a pair of bar-type swingable sensors vertically mounted in said guide lane to cross the lane, said bar-type swingable sensors being positioned in opposite sides of said pair of rotary disc blades;

a link connecting said pair of bar-type swingably sensors with each other to move them in synchronism when one of them is swung by an envelope passing through said guide lane; and a pair of contact assemblies coupled with said pair of bar-type swingable sensors, one of said contact assemblies being operated by one of said bar-type swingable sensors to establish rotational directions of said reversible electric motor and said rotary disc blades when the head of an envelope enters said opener from either side and passes said guide lane in either direction to swing one of said bar-type swingable sensors, the other of said bar-type swingable sensors being swung through said link into a position where the other of said contact assemblies coupled with the other of said bar-type swingable sensors remains opened or turned off.

* * * * *